United States Patent [19]

Wilhelm

[11] 3,959,422

[45] May 25, 1976

[54] PROCESS OF MANUFACTURING CONCRETE MOLDINGS

[76] Inventor: Denk Wilhelm, 30847 Mayflower, Roseville, Mich. 48066

[22] Filed: Sept. 3, 1974

[21] Appl. No.: 502,873

Related U.S. Application Data

[63] Continuation of Ser. No. 247,973, April 27, 1973, abandoned.

[52] U.S. Cl. ..... 264/23; 264/71; 264/333; 264/336; 264/DIG. 43

[51] Int. Cl.[2] ..... B06B 3/00; B28B 1/08

[58] Field of Search ..... 264/23, 71, 72, 333, 264/334, 336, DIG. 43

[56] References Cited

UNITED STATES PATENTS

| | | | |
|---|---|---|---|
| 1,453,746 | 5/1923 | Carey | 264/333 |
| 2,161,822 | 6/1939 | Kogl | 264/71 X |
| 2,614,312 | 10/1952 | Rankin | 264/23 |
| 3,047,929 | 8/1962 | Steiro | 264/23 |
| 3,055,146 | 9/1962 | Lobato | 264/31 X |
| 3,711,587 | 1/1973 | O'Connor | 264/71 |
| 3,739,050 | 6/1973 | Koncz | 264/333 |

*Primary Examiner*—Robert F. White
*Assistant Examiner*—Thomas P. Pavelko
*Attorney, Agent, or Firm*—McGlew and Tuttle

[57] ABSTRACT

A concrete mixture is provided which is homogeneous and free of lumps and comprises 5–15 parts by weight of sand, 2–3 parts by weight of cement and 1 part by weight of water. Said mixture is charged into a mold in a molding machine in a charging operation having a duration of about 30–120 seconds. Said mold is vibrated in said molding machine in a vibrating operation from the beginning of said charging operation until after said charging operation, whereby said mixture is compacted and air is expelled from said mold and a molding is formed therein. At least part of said mold is removed from said molding when said vibrating operation has been completed and before said molding has completely set. Said molding is stored outside said molding machine until said molding has completely set.

3 Claims, 6 Drawing Figures

PROCESS OF MANUFACTURING CONCRETE MOLDINGS

This is a continuation of application Ser. No. 247,973, filed Apr. 27, 1972, now abandoned.

This invention relates to a process of manufacturing building elements and molded blocks of concrete, particularly of beams or joists, floor or ceiling elements, stairs, or the like, by casting in molds, in which process the completely filled mold is vibrated for a short time to expel air and to compact the material and the workpiece is subsequently stored outside the molding machine until the concrete has completely set. The invention also relates to a plant which serves to carry out the process and comprises a molding machine comprising a mold, which is rotatable about its longitudinal axis, and a charging hopper disposed over the mold.

In such processes of making building elements or shaped blocks of concrete, such as profiled beams or joists of various kinds, stairs or the like, the starting material has generally consisted of concrete mixes consisting of 3–5 parts by weight of said, 1 part of cement and water. The molding machine is initially brought into a molding position in which the charging opening of the mold is on top and has a horizontal orientation. From the charging hopper placed on the mold, the latter is then charged with the concrete mix. During this operation, material must remain in the charging hopper in such a quantity that additional concrete can be charged when the material in the mold has been compacted by being vibrated for about 20 seconds. After the entire charging operation has been completed, the frame carrying the mold in the molding machine is rotated through 180° and the mold is emptied. The resulting molding of concrete is stored on a prepared support, on which the molding remains for about 24 hours until it has completely set. Owing to the relatively large water content of the concrete, the same can be vibrated only for a short time in this conventional process of manufacture because a prolonged vibration would cause the concrete to adhere to the walls of the mold so that the concrete could no longer be removed from the mold. On the other hand, a vibration of the concrete for a time which is too short will not result in a satisfactory compaction of the concrete so that air will be occluded in the molding and the surface of the molding will be very rough. Finally, the concrete will still be viscous in part as it is removed from the mold so that the molding may even be appreciably deformed. For these reasons, building elements and molded blocks made by this known process of manufacture must be subjected to an additional finishing treatment, e.g., by an application of plaster.

According to the invention, the process which has been described initially hereinbefore and serves to manufacture building elements and molded blocks of concrete is carried out in an improved manner in that the starting material consists of concrete having a low moisture content and comprises about 5–15% by weight of sand, 2–3 parts of cement and 1 part of water, said starting material is charged into a mold in a completely homogeneous state, in which it is free of lumps, the operation of charging the mold takes about 30–120 seconds, depending on the size of the mold, and the mold is intensely vibrated from the beginning of the charging operation and for a time which is a multiple of the duration of the charging operation, preferably for a time of about 60–300 seconds, whereafter the mold is partly or entirely removed from the workpiece and the latter is removed from the molding machine and is stored only for a short time until it has completely set. The mold in the molding machine is suitably vibrated from the beginning of the charging operation at a frequency f of about 150–200 Hz and with a thrust force of about 1500–3000 kilograms.

In a preferred embodiment of this process of manufacture, the horizontally disposed, composite mold is assembled and rotated about its horizontal longitudinal axis to a molding position, in which the profile is downwardly inclined everywhere, and that the mold which contains the completely treated workpiece is rotated further to its stripping position, in which the outer mold is removed and the workpiece, which is suitably supported by the core of the mold, is placed in position for conveyance onto a conveyor which succeeds the molding machine and consists suitably of a roller conveyor. In the specific case of a manufacture of stairs having a substantially angle-shaped profile, the mold is first assembled so that the outer mold is underneath and the core is pushed into position from in front. The mold is then rotated through about 100° to its molding position, in which the tread is upwardly inclined. Finally, the filled mold is rotated further through about 80° to its stripping position.

In this process of manufacture, the completely molded building element, such as a stair, is continuously advanced on a conveyor while being subjected to a heat treatment for about 2–4 hours and during said heat treatment may be entirely exposed or may be supported by the mold core. The heat treatment should suitably consist of a drying phase of about 10 minutes, serving to harden the surface, and a subsequent treatment with water vapor for about 2–4 hours.

In carrying out this process of manufacture according to the invention and particularly in the preparation of the low-water-content concrete containing the components in the above-mentioned quantitative proportions, it is essential to avoid a formation of lumps. The resulting concrete mixture, which is satisfactorily homogeneous, is then charged in a loose state into the mold during a time of about 30–120 seconds, depending on the size of the mold, and from the very beginning of this charging operation the vibrator is operated to vibrate the concrete which is thus satisfactorily compacted from the bottom of the mold upwardly and remains free of occluded air. When the mold has been completely filled with concrete, the vibration of the mold is continued until the concrete has been vibrated for a total time of 60–300 seconds, depending on the size of the mold. The vibration is preferably effected at a frequency f of about 150–200 cycles per second and with a thrust force of about 1500–3000 kilograms. The performance of the vibration for the prescribed time is of decisive significance for the quality of the resulting moldings. A vibration for a time which is too short will result in a concrete which is not sufficiently compacted and lacks the required hardness. A vibration for a time which is too long will result in a segregation of water at the bottom of the mold, and the resulting dilution of the concrete will result in the disadvantage which has been discussed hereinbefore in connection with the known manufacturing processes.

Further in accordance with the invention, the plant described hereinbefore and serving to manufacture building elements or molded blocks of concrete and consisting of a molding machine which comprises a mold, which is rotatable about its longitudinal axis, and a charging hopper disposed over the mold, is desirably designed so that a pivoted table is disposed under the rotatably mounted mold and is lowered during the operation of the molding machine and after the completion of the charging and vibrating operations is adapted to be raised to a position for receiving the molding.

In a preferred embodiment of this manufacturing plant, the molding machine is succeeded by a conveyor, particularly a roller conveyor or another conveyor for conveying the completely molded workpieces which have been exposed, and a short and suitably covered zone is provided over the conveyor and serves for supplying heat resulting in a rapid predrying of the surface of the workpieces. This zone is succeeded by a steam chamber, which has a length which is a multiple of that of the drying section. The workpieces are placed in succession onto the roller conveyor or other conveyor and the conveyor moves the workpieces through both sections continuously and during about 2–4 hours.

In the accompanying drawings.

Figure 1:
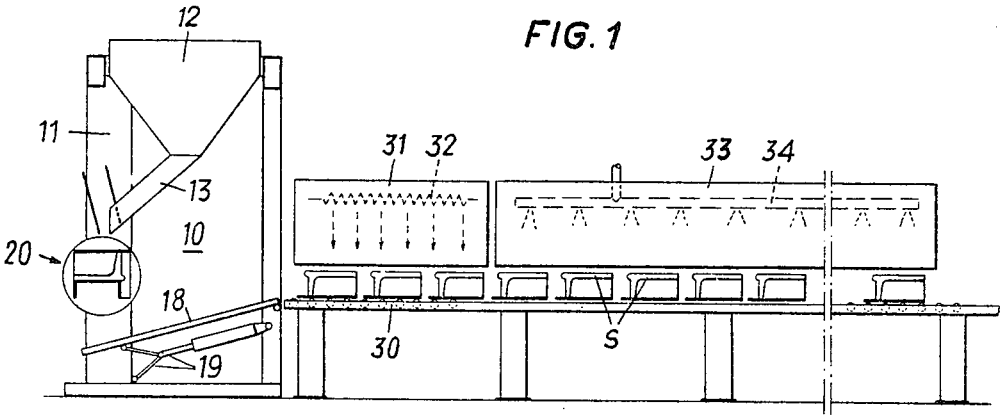
FIG. 1 shows by way of example an embodiment of an entire plant according to the invention for the manufacture of building elements, specifically stairs.

The plant shown in FIG. 1 comprises a molding machine 10 and a conveyor 30. The molding machine comprises a charging device 12-13, a casting mold 20, and a table 18 for receiving the moldings S. The conveyor 30 consists of a roller conveyor, which succeeds the molding machine 10 and extends laterally therefrom on the level of the delivery table 18. The molded workpieces, e.g., stairs S, are moved or pushed from the delivery table 18 of the molding machine onto the roller conveyor 30 and on the latter are continuously conveyed and while they are still supported by the respective molding cores 25. On the conveyor 30, the workpieces are subjected to a relatively short drying treatment in the heating device 31 and to a heat treatment in the steam chamber 33 until the concrete has been completely cured.

Figure 2:
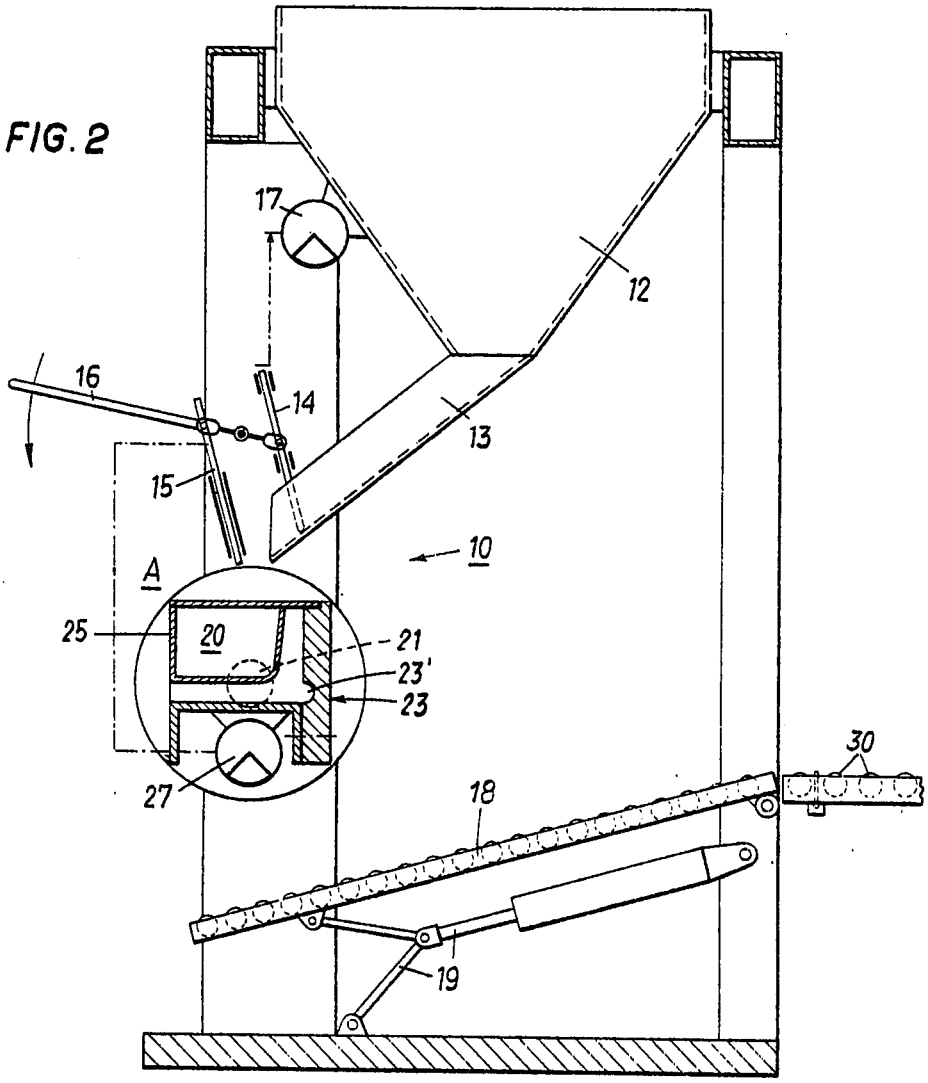
FIG. 2 is an enlarged view showing the molding machine proper, which comprises a charging device, casting mold and vibrator.

As is apparent from FIG. 2, the molding machine 10 comprises a feed hopper or charging hopper 12, which is suitably resiliently suspended in the machine frame 11, a chute 13 attached to the lower end of the hopper 12, and a vibrator 17 attached to the side of the hopper. The chute 13 is adapted to be shut off at its lower end by a shut-off valve 14, which is connected by a two-armed operating lever 16 to an inclined guide plate 15, which is disposed over the mold 20. As is apparent from FIG. 5, the operation of the hand lever 16 results in the following operations: The shutoff valve 14 is lifted from the chute 13; the guide plate 15 is pushed against the casting mold 20; at the same time, as is indicated by the dash-dot connections, the vibrator 17 cooperating with the feed hopper 12 and a vibrator 27 associated with the casting mold 20 are started.

A delivery table 18 is disposed in the frame 11 of the molding machine 10 and extends throughout the width of the machine under the casting mold 20. On that side of the machine frame 11 which is remote from the casting mold 20, the table 18 is hinged to the frame 11. On the other side, under the casting mold 20, the table 18 is adapted to be lowered and to be raised to a vertical position under the control of a pneumatically or hydraulically controlled toggle linkage 19. The delivery table 18 is provided with rollers, on which the moldings, such as stairs S, which have been removed from the casting mold 20, suitably together with their molding cores 25, are removed and delivered to the succeeding roller conveyor 30, which is disposed outside the molding machine 10.

Figure 3:
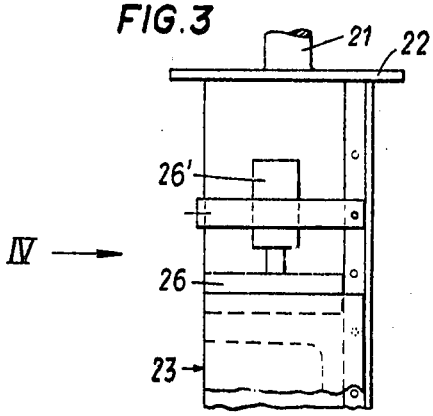
FIGS. 3 and 4 are, respectively, a top plan view and side elevation showing the casting mold.
Figure 4:
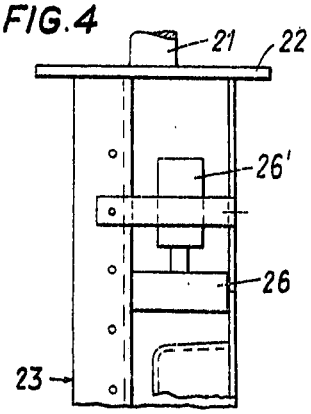

The casting mold 20 is pivoted in the machine frame 11 about horizontal trunnions 21, which are disposed below the outlet of the chute 13 connected to the feed hopper 12. The casting mold 20 is shown in FIGS. 2, 3 and 4 in its two main elevations and is shown in FIG. 2 in its neutral position, in which it is installed. The casting mold 20 consists of two disc-shaped vertical side plates 22, which are connected to the trunnions 21, and of horizontal formwork parts, which are clamped between the side plates and consist of a vertical baseplate 23 provided with a longitudinal groove 23' for molding the nose of the stair, a channel member 24, one leg of which is secured to the baseplate 23 and the horizontal web of which covers the tread of the molded stair S, and a removably inserted hollow core 25, which has a longitudinal flange resting on the top edge of the baseplate 23. The casting mold 20 has also inserted therein at each end a vertical limiting member 26, which is axially adjustable by a pneumatic or hydraulic actuator 26' to control the width of the molded stairs S. For a coarse adjustment, the actuator 26' may be secured by screws or pins to one of a plurality of points of the mold 20. A separate vibrator 27 is attached to the casting mold 20 and is automatically started when the charging operation is initiated in that the hand lever 16 is operated to open the charging hopper 12-13.

Figure 5:
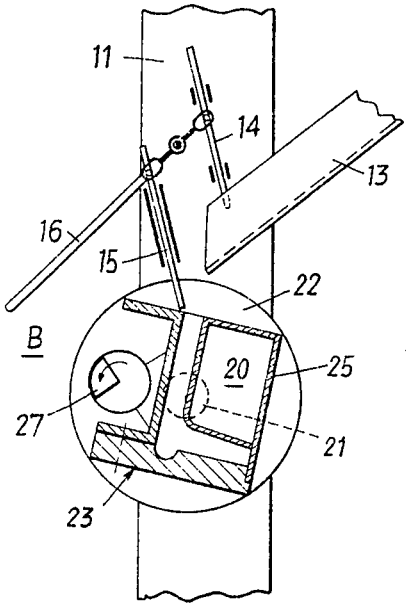
FIGS. 5 and 6 are transverse sectional views showing a portion of the plant with the casting molds in two operating positions, FIG. 5 showing the mold in a charging position B and FIG. 6 showing the mold in the position C-D in which the molded stairs are removed.
Figure 6:
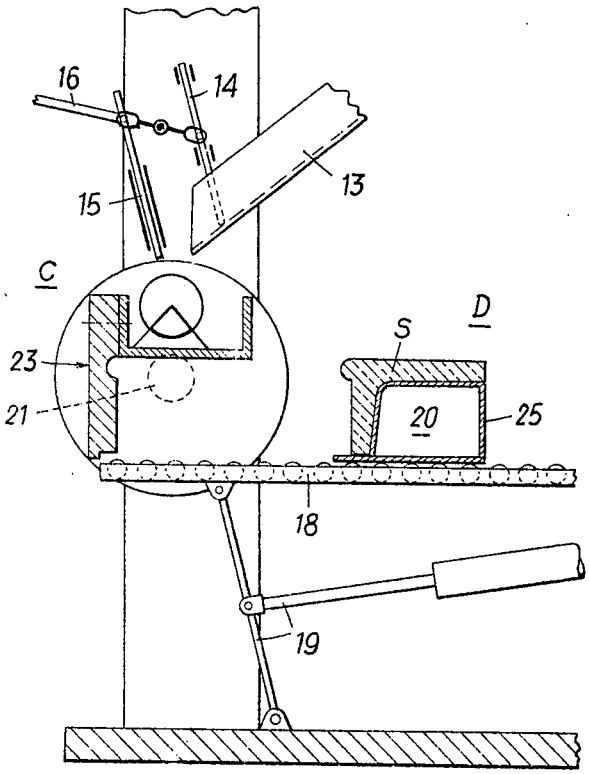

FIGS. 5 and 6 show the casting mold 20 in its two operating positions: From the vertical position A (FIG. 2) in which the casting mold 20 is assembled, the mold is rotated about its horizontal longitudinal axis 21 through about 100° first to the charging position B shown in FIG. 5. In this position, the charging slot is on top and the profile-defining surfaces are downwardly inclined. When the casting mold 20 has reached this position B, the hand lever 16 is operated to open the shut-off valve 14 of the chute 13 and to lower the guide plate 15 as far as to the charging slot of the mold. During the succeeding charging operation, the delivery table 18 remains in its lowered, inclined position shown in FIG. 2 so that the vibration imparted to the casting mold 20 by the vibrator 27 will not be hindered. As has been mentioned, this vibration is continued for a time which is a multiple of the charging time required. As is apparent from FIG. 6, the casting mold 20 is rotated further through about 80° to the stripping position C when the vibration has been terminated so that the mold has now been rotated through 180° from its initial position A. The delivery table 18 is then raised by the toggle linkage 19 to a horizontal position and is fixed in this position. When the arrangement is in this final position C, the molding core 25 resting on the roller conveyor of the delivery table 18 together with the molded stair S is pulled out parallel itself to the position D for conveyance. The other formwork parts 23 and 24 remain clamped in the casting mold 20. The workpiece which is supported by the molding core 25 is now moved on the rollers of the delivery table 18 to the succeeding horizontal roller conveyor 30, which is about 15 meters long, and on said roller conveyor 30 is subjected to the aftertreatment, which has a total duration of about 2–4 hours. The successive workpieces are continuously moved first for about 10 minutes through a short covered zone 31, in which a heater 32 is installed, and then through a steam chamber 33 in which a steaming system 34 is installed. In the heating unit 31, 32, a sufficient surface hardness should be achieved so that the curing in the succeeding steam bath will not be accompanied by a deformation, which could otherwise occur. During its longer residence time of approximately 2–4 hours in the steam chamber 33/34, water is supplied to the concrete in such an amount that the setting time is shortened so that the molded blocks or stairs leaving the roller conveyor are sufficiently hard to be stored without a risk of fracture or deformation.

What is claimed is:

1. A process of manufacturing a concrete stair tread and riser comprising the steps of forming an homogeneous concrete mixture free of lumps and comprising 5–15 parts by weight of sand, 2–3 parts by weight of cement, and 1 part by weight of water; providing a two-part mold having a base plate, a fixed mold part secured to the base plate and a separable mold part removable from the base plate, the mold parts conjointly defining a mold cavity having the profile of a stair tread and riser, the mold having an initial position in which the stair tread profile is substantially horizontal and the riser profile extends upwardly from the tread profile; rotating the mold about its longitudinal axis to a charging position in which all surfaces of the mold cavity slope downwardly; charging said mixture without lumps into the mold while the latter is in its charging position, during a charging period having a duration of about 30–120 seconds; while the mold is in its charging position with said mixture therein, vibrating the mold from the beginning of the charging operation for a duration of 60–300 seconds until after the charging operation is completed to compact the mixture and avoid lumping, expel air from the mold and to form a molded concrete stair tread and riser in the mold; after the vibrating operation has been completed and before the molding has completely set, rotating the mold about its longitudinal axis to a stripping position in which the molded stair tread extends horizontally and the molded riser extends downwardly from the molded stair tread, with the molded stair tread and riser being supported entirely on the separable part of the mold; separating the separable part of the mold from the fixed part and base plate thereof along with the molded stair tread and riser; thereafter subjecting the molded stair tread and riser to a drying step to harden the surface thereof; and finally subjecting the molded stair tread and riser to a heat treatment with water vapor for a duration of 2– 4 hours, said vibrating operation being carried out from the beginning of said charging operation at a frequency of about 150–200 cycles per second and with a thrust force of about 1500–3000 kilograms, and carrying out the drying by heat treatment for a period of substantially ten minutes.

2. A process as set forth in claim 1, in which said treatment with water vapor is effected by steam during a period of substantially 2–4 hours.

3. A process as set forth in claim 1 in which, after separation of the separable part of the mold and the molded stair tread and riser from the fixed part of the mold and the mold base plate, the separable part of the mold, carrying the molded stair tread and riser, is placed on a continuously moving conveyor and, while being continuously moved by the conveyor, the molded stair tread and riser is subjected to said water vapor and then said drying step.

* * * * *